United States Patent [19]

Gratzmuller

[11] 4,204,461

[45] May 27, 1980

[54] HYDRAULIC CONTROL SYSTEM FOR ELECTRIC CIRCUIT-BREAKERS

[76] Inventor: Claude A. Gratzmuller, 97 Avenue Victor Hugo, 75016 Paris, France

[21] Appl. No.: 632

[22] Filed: Jan. 2, 1979

[30] Foreign Application Priority Data

Jan. 4, 1978 [FR] France ..... 78 00106

[51] Int. Cl.[2] ..... F15B 13/043; F15B 1/02

[52] U.S. Cl. ..... 91/454; 60/413; 60/484; 91/461

[58] Field of Search ..... 60/403, 413, 416, 494, 60/484; 91/454, 5, 461

[56] References Cited

U.S. PATENT DOCUMENTS 2,900,960 8/1959 Gratzmuller ..... 91/454 X 2,933,069 4/1960 Gratzmuller ..... 91/454 X 2,948,262 8/1960 Gratzmuller ..... 91/454 X

*Primary Examiner*—Edgar W. Geoghegan

*Attorney, Agent, or Firm*—Holman & Stern

[57] ABSTRACT

The closure and trip pilot valves of a circuit-breaker control unit are actuated by a hydraulic device controlled by a pressure drop which appears in control lines in response to the transient opening of a drain electrovalve within a control cubicle. Thus the pressure-drop hydraulic signal transmitted from a single central control cubicle for closing or tripping a circuit-breaker dispenses with the need for any electrical system and permits the control of a plurality of circuit-breakers or breaker modules solely by means of small-section lines providing hydraulic connections between the central control cubicle and each breaker control unit.

12 Claims, 4 Drawing Figures

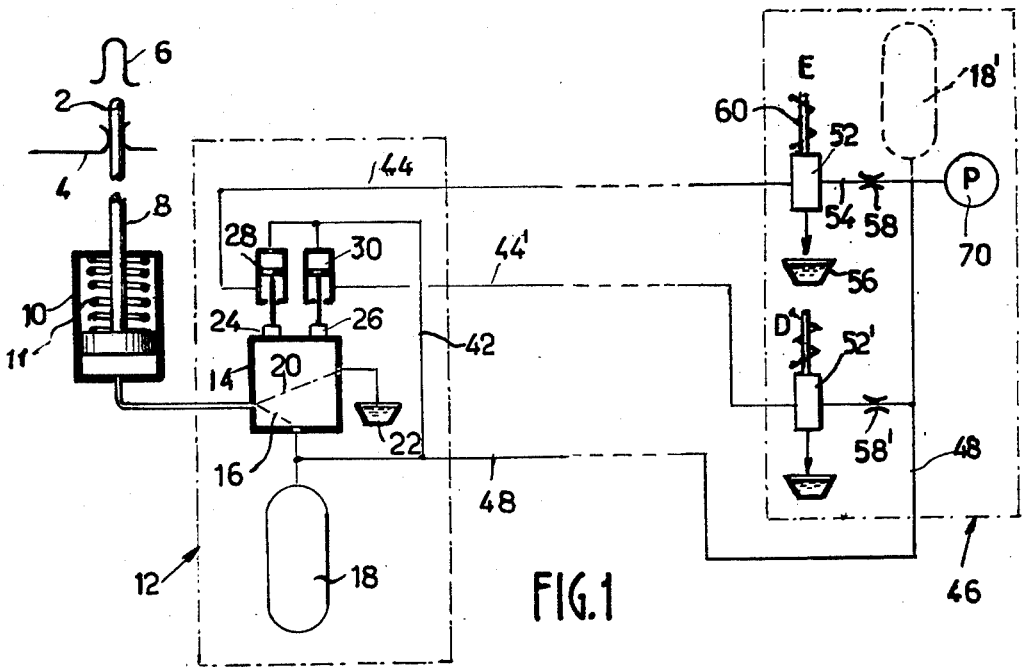
FIG.1
FIG.2
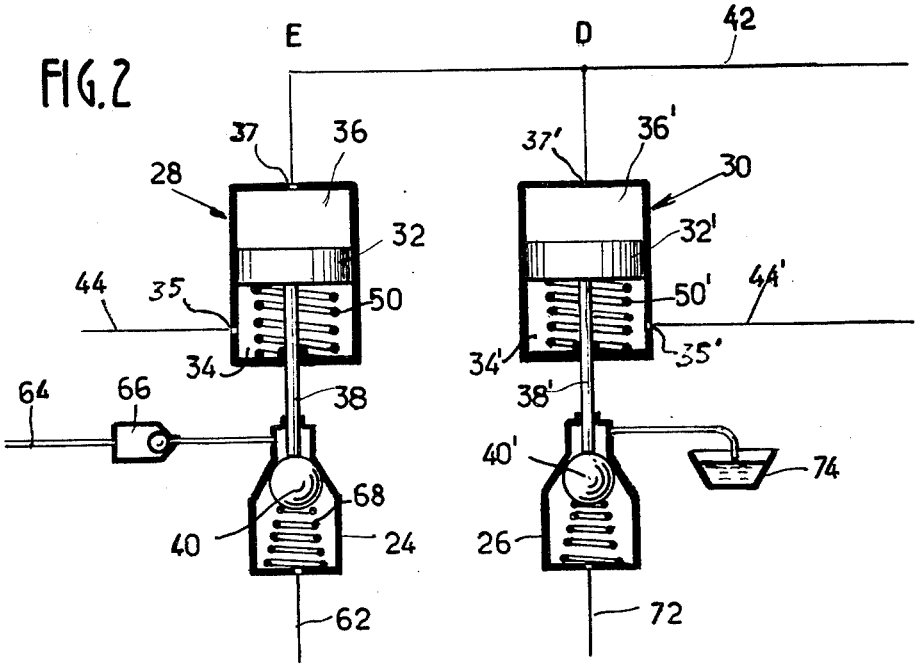

146
18'
70
P
76
76'
58
58'
52
52'
144
144'
44
44'
112
12

110
10
86
86'
80
82
84
84'
88
92
90
78
78'
44
44'
144
144'
146
112
12
144'

HYDRAULIC CONTROL SYSTEM FOR ELECTRIC CIRCUIT-BREAKERS

This invention relates to a hydraulic control system for an electric circuit-breaker which can be remote-controlled from an order emitter.

A hydraulic control system for a circuit-breaker essentially comprises in known manner: a jack for actuating the moving contact of the circuit-breaker; a source of hydraulic fluid under pressure; and a set of hydraulic switching elements hereinafter designated as a "control unit" and comprising at least one valve for supplying and draining the operating jack. The displacement of said valve towards either of its two positions is effected by means of two pilot valves or so-called closure and trip valves which are operated in a transient manner so as to initiate the operation which consists in closing or tripping the circuit-breaker.

In modern installations, the control unit is mounted in the immediate proximity of the jack and in many instances is even mounted against the jack in order to reduce operating times and to prevent hydraulic pressure drops.

In all these installations, the closure and trip valves must permit of remote control at a distance from the circuit-breaker, either for safety reasons or above all by reason of the fact that a number of circuit-breakers (for example the three breakers mounted on the three phases of a power supply system) or a number of breaker modules (unitary breakers mounted in series on a single phase of a power supply system) must be closed or tripped open simultaneously by means of a single closing or tripping order. In consequence, the closing and tripping pilot valves employed up to the present time have consisted solely of electrovalves energized from an order emitter located at a suitable distance from the breaker or breakers.

Circuit-breaker control systems of the type mentioned above are well known and have been described for example in French Pat. No. 1,098,565 and in the corresponding patent of Addition No. 67 250 filed respectively on Jan. 15th, 1954 and Dec. 28th, 1954, as well as in French Pat. No. 1,355,701 filed on Feb. 6th, 1963, all these patents having been filed in the name of Jean Louis Gratzmuller.

It is apparent from the foregoing that control units of known types consisted not only of hydraulic apparatus but also of electrical apparatus. This usually made is necessary to install a cubicle containing these items of apparatus in the immediate vicinity of each circuit-breaker or module. It was clearly necessary in addition to provide a so-called "control cubicle" which served to house hydraulic and electrical safety devices for checking the open or closed position of the circuit-breakers and for transmitting orders emanating from the order emitter after checking the possibilities of execution. Finally, hydraulic connecting lines having a substantial cross-sectional area in some instances and electrical connecting lines were provided with a view to coupling the control cubicle with the control unit of each circuit-breaker.

By virtue of the present invention, installations of this type can be considerably simplified since each control unit need be constituted only by hydraulic apparatus whilst the pilot valves are controlled by hydraulic signals, thus dispensing with the need for any electrical system in the modules. A further advantage of this design lies in the fact that the connections between each control unit and the control cubicle can consist only of hydraulic connections designed in the form of small-section piping. Finally, since each control unit is a purely hydraulic apparatus, it can be constructed in the form of a leak-tight block which does not call for the installation of a separate cubicle for each circuit-breaker or each circuit-breaker module.

The invention has for its object a hydraulic control system of the above-mentioned type in which each pilot valve is controlled by a hydraulic device mounted against said pilot valve. Said device is responsive to a pressure drop which appears within a low-discharge control line and brings the corresponding pilot valve into its active position in response to said pressure drop. Each control line terminates in the above-mentioned control cubicle and is connected within said cubicle to a drain electrovalve which is capable of transient operation and constitutes respectively the breaker closure control element and the breaker trip control element. Provision is made for means whereby said hydraulic lines and devices are continuously re-supplied at a low rate of flow and normally maintained at high pressure outside the transient periods of connection of said drain valves to the collector-tank.

As will become apparent hereinafter, the fact that the pilot valves are controlled by a pressure-drop signal transmitted by the control lines results in the achievement of very short response intervals between transmission of the order from the control cubicle and execution of the order (either for breaker-closing action or breaker-tripping action) since it is unnecessary to drain said lines to atmospheric pressure.

The invention is particularly applicable to the control of circuit-breakers of the type which ensures elastic return to the trip position and holding in the closed position after disappearance of the transient breaker-closing signal by means of a self-maintaining hydraulic circuit which forms part of the control unit. Hydraulic control systems of this type have been described in the French patents cited earlier.

In accordance with the invention and in the case under consideration, the trip pilot valve which is controlled by a pressure drop within the corresponding control line is a valve for draining the self-maintaining hydraulic circuit provided within the control unit.

Finally, the invention finds a particularly advantageous application in the control of a plurality of circuit-breakers or circuit-breaker modules from a single central control cubicle. In this case and in accordance with the invention, all the above-mentioned control lines which terminate in the hydraulic devices of the valves for tripping all the circuit-breakers are connected together within the central control cubicle to a single drain valve constituting a single transiently operated breaker-tripping element for the plurality of circuit-breakers. Similarly, all the aforementioned control lines which terminate in the hydraulic devices of the valves for tripping all the circuit-breakers are connected together within the central control cubicle to a single drain valve constituting a single breaker-closing element for the plurality of circuit-breakers.

A more complete understanding of the invention will be gained from the following detailed description and from a study of the accompanying drawings in which a number of different embodiments of the invention are shown by way of example without any limitation being implied, and in which:

FIG. 1 is a diagrammatic presentation of the system in accordance with the invention as applied to the control of a single circuit-breaker;

FIG. 2 is a sectional view of the hydraulic devices for controlling the breaker-closing and breaker-tripping pilot valves;

Figure 3:
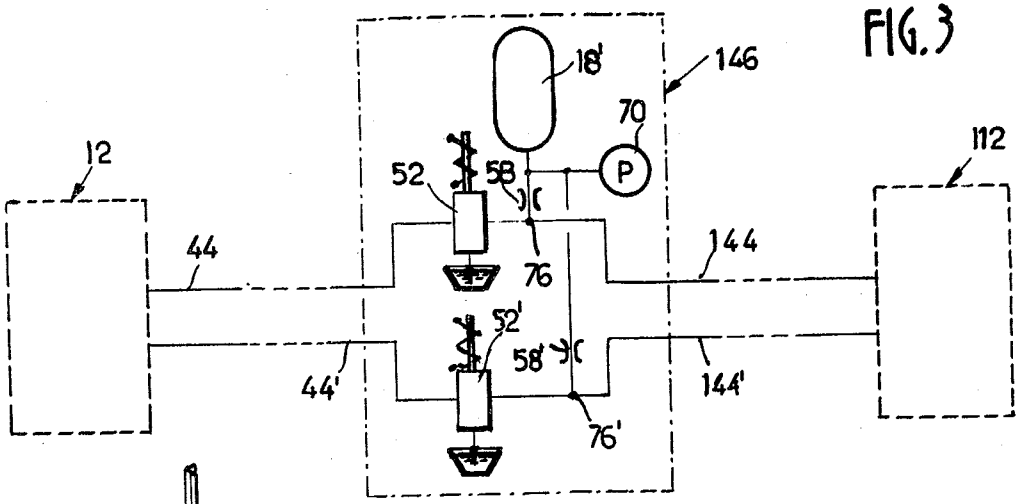
FIG. 3 is a diagrammatic presentation of the system in accordance with the invention as applied to the centralized control of a plurality of circuit-breakers or circuit-breaker modules.

There is shown in FIG. 1 an electric circuit-breaker which is represented diagrammatically by its moving contact 2 and its two stationary contacts 4 and 6, the moving contact being actuated by the operating rod 8 of a hydraulic jack 10. The circuit-breaker illustrated in the figure is of the type which provides continuous elastic return to the open position. The elastic restoring means shown in the figure are constituted by a spring 11 but could be constituted by a fluid under pressure. The control unit 12 essentially comprises a supply and drain valve 14 which is adapted to establish either the communication (connection 16) between the jack 10 and a source of liquid under pressure such as a hydropneumatic accumulator 18 (closing of the circuit-breaker and maintaining it in the closed position) or the communication (connection 20) between the jack 10 and a low-pressure collector-tank 22 (tripping of the circuit-breaker).

The valve 14 is a high-discharge valve for rapidly supplying and draining the jack 10 and is switched towards either of its two positions (16 or 20) by control valves, namely the closure valve 24 and the trip valve 26 which are operated in a transient manner. Hydraulic control units of this type are well known and have been described in the patents cited earlier. The pilot valves 24–26 which had been in use up to the present time consisted of electrovalves in which the electromagnet could be energized from a distance by means of an order emitter.

In accordance with the present invention, the pilot valves 24-26 are no longer actuated directly by an electric signal but by a hydraulic pressure-drop signal.

To this end, the pilot valves 24–26 are actuated respectively by pressure-regulating hydraulic devices 28–30 which are mounted against the corresponding pilot valve and one form of construction of which is shown in greater detail in FIG. 2.

Each hydraulic device 28–30 comprises a cylinder which is divided by a piston 32—32' into two chambers 34–36 and 34'–36'. The piston rods 38-38' produce action on the check balls 40–40' of the pilot valves 24–26 of the control unit. Said valves are shown in FIG. 2 in their normal rest positions.

The chambers 36–36' each have an inlet 37–37' and are continuously put into communication with the pressure of the accumulator 18 through pipe lines 42 whilst the chambes 34–34' have an inlet 35–35' and hydraulic pipe lines 44–44' or so-called "control lines" in which the pressure can be reduced from a control cubicle 46 (shown in FIG. 1) by means which will be described hereinafter. The control cubicle 46 can be located at a distance of several meters from the circuit-breaker to be controlled.

The control lines 44–44' which terminate in the control cubicle 46 are continuously re-supplied with hydraulic fluid under pressure by connecting said control lines to the accumulator 18 by means of lines 48 or, by way of alternative, to an accumulator 18' which can be provided within the control cubicle or in the vicinity of this latter.

In the position shown in FIG. 2, the pressure exerted on the pistons 32–32' within the chambers 36–36' is balanced by the pressure exerted on the opposite faces of the pistons by the liquid under pressure contained in the chambers 34–34' and by the force of the springs 50–50' which compensate for the difference between the active surface areas of the two piston faces as a result of the presence of the piston rods 38–38'.

In this rest position of the pilot valves 24–26', the check balls 40–40' of these valves are closed.

The following description will now be concerned with the remote-control means for initiating transient opening of the pilot valves 24–26 from the control cubicle, thereby in turn initiating respectively the closing action or tripping action of the circuit-breaker.

Within the control cubicle 46, a drain valve 52 is interposed in the hydraulic line 44 and, in the normal closed position, establishes a communication between the line 44 and the line 54 which provides a connection with the accumulator 18 (or 18'). In the open position of the valve 52, the line 44 is put into communication with a low-pressure collector-tank 56. A simple two-way drain valve is employed in the preferred embodiment of the invention so that, in the open position of the valve 52, both the lines 44 and 54 are connected to the collector-tank at the same time but a nozzle 58 having a small cross-sectional area with respect to that of the drain valve in the open position is interposed in the connecting line 54.

The drain valve 52 is preferably an electrovalve which can be operated in a transient manner by means of a high-speed electromagnet 60 of a type which is well known in circuit-breaker control systems.

The control line 44' of the trip pilot valve 26 is equipped in the same manner as a drain electrovalve 52' which is connected-up exactly as described in the foregoing.

In order to initiate a breaker-closing action, the operation of the installation is as follows: in the position shown in the drawings, the pipe lines 54–44 and the chamber 34 of the hydraulic device 28 are filled with liquid at the pressure P of the accumulator 18 (or 18'). The pipe lines 48–42 and the chamber 36 are filled with liquid at the same pressure P.

If the electrovalve 52 is transiently energized by means of the order emitter located within the control room of the electrical station, the pressure within the pipe line 44 is relieved and decreases by a quantity $\Delta P$ as is also the case within the chamber 34. The pressure P which continues to prevail within the chamber 36 exceeds the sum of the pressure $P-\Delta P$ within the chamber 34 and of the force of the spring 50, with the result that the piston 34 is displaced downwards (as shown in FIG. 2) and opens the check ball of the closure pilot valve 24.

By way of example, the pilot valve just mentioned is of a type which is well known in circuitbreaker control units. In the open position, the valve establishes a communication between a pipe line 62 which is connected to the accumulator 18 and another pipe line 64 which is connected to the control jack (not shown) of the main supply and drain valve in order to bring this latter into the (supply) position 16 shown in FIG. 1. After disappearance of the transient breaker-closing signal, the valve is maintained in the supply position by the self-maintaining hydraulic circuit described in the patents cited earlier. A non-return valve 66 is interposed in the pipe line 64 in known manner.

After the disappearance of the transient breakerclosing signal emitted by the drain electrovalve 52, this latter closes again and the pipe line 44 is again resupplied by the line 54 via the nozzle 58 at a low rate of flow. The pressure within the chamber 34 is thus restored to the same value as the pressure within the chamber 36; this pressure P' is lower than the initial pressure P by reason of the fact that the accumulator 18 has delivered the quantity of oil which is necessary for supplying the jack 10 of the circuit-breaker in order to bring this latter to the closed position. Since the hydraulic pressures between the two chambers 34 and 36 are identical, the piston 32 undergoes an upward displacement and the check ball 40 re-closes under the action of its spring 68. The hydraulic device 38 then returns to the rest position shown in FIG. 2.

If the new pressure P' is lower than the pressure required for re-starting the accumulator-recharging pump 70, the pump re-charges the accumulator 18 through the small-section pipe 48 to the chosen pressure P whilst the pressures within the chambers 34 and 36 therefore always remain equal and the pilot valve 24 therefore remains closed.

Control of the trip pilot valve 26 by means of the drain electrovalve 52' is identical with the operation described in connection with control of the closure pilot valve 24. It can simply be noted with reference to FIG. 2 that, when the pilot valve 26 is open, a pipe line 72 which is connected to the self-maintaining hydraulic circuit (not shown) of the control unit 42 is put into communication with a low-pressure collector-tank 74.

The foregoing has clearly brought out the fact that the invention permits remote control of a circuit-breaker from a control cubicle solely by means of small-section hydraulic connections (lines 44, 44', 48), for example by means of tubes which have an internal diameter of 3 mm and can be easily fitted in position since they are not rigid and can be uncoiled.

It is also readily apparent that the valves 24 and 26 are actuated simply by a pressure-drop signal within the control lines 44–44' without any need to drain these latter to atmospheric pressure. A very fast response is therefore obtained since oil decompression within the pipe lines 44–44' is alone sufficient to actuate the hydraulic devices and the decompression wave propagates in the oil at the velocity of sound. This speed of response is particularly valuable for trippingout the circuit-breaker, which is a safety operation.

It should finally be noted that the absolute value P or P' of oil pressure within the control system has no influence whatsoever on the reliability of the system in accordance with the invention since the hydraulic signal consists only of a relative pressure drop.

There is shown in FIG. 1 a circuit-breaker of the type providing elastic return to the trip position under the action of a spring. It is readily apparent, however, that the invention also applies to a circuit-breaker of the type which is actuated by a double-acting jack or by a differential jack with hydropneumatic restoring action.

The invention is of special interest when it is intended to be applied to simultaneous control of a plurality of circuit-breakers or breaker modules from a central control cubicle. FIG. 3 illustrates the case of two modules each controlled by a control unit 12 or 112 which ar identical with the control unit 12 described with reference to FIG. 1 and located at a certain distance from each other. In this case the two trip control lines 44 and 144 are connected to the control cubicle 146 at a common point 76; when energized, a single drain electrovalve 52 makes it possible to reduce the pressure in both lines 44 and 144 at the same time or in other words to transmit the hydraulic trip signal to both control units 12 and 112 simultaneously.

The same applies to the two trip control lines 44' and 144' which are connected to the control cubicle at a common point 76' and in which the pressure can be reduced simultaneously by means of the single drain electrovalve 52' in order to transmit the trip order to the two units 12–112.

Manual control of closing or tripping of all the circuit-breakers can be obtained by actuating the electrovalves 52 and 52' by hand.

As in the case of FIG. 1, the control lines 44-144–44'-144' are re-supplied with liquid under pressure through nozzles 58;14 58' which have a much lower output than the drain valves 52–52' in the open position.

As in the case of FIG. 1, provision can be made for only one local hydropneumatic accumulator 18 in the proximity of each module, that is to say within each control unit 12 and 112. These accumulators are recharged through pipe lines equivalent within the control cubicle 146. By way of alternative, provision can also be made for an additional central accumulator 18'.

In some installations, requirements laid down by the user and dictated by safety considerations make it necessary to provide for a plurality of closure control elements and especially trip control elements.

The present invention lends itself very readily to the installation of additional elements of this type since it is only necessary to mount an additional drain valve at any one point of the control lines 44–44', 144–144', in addition to the main valve 52 or 52' provided within the central control cubicle.

Figure 4:
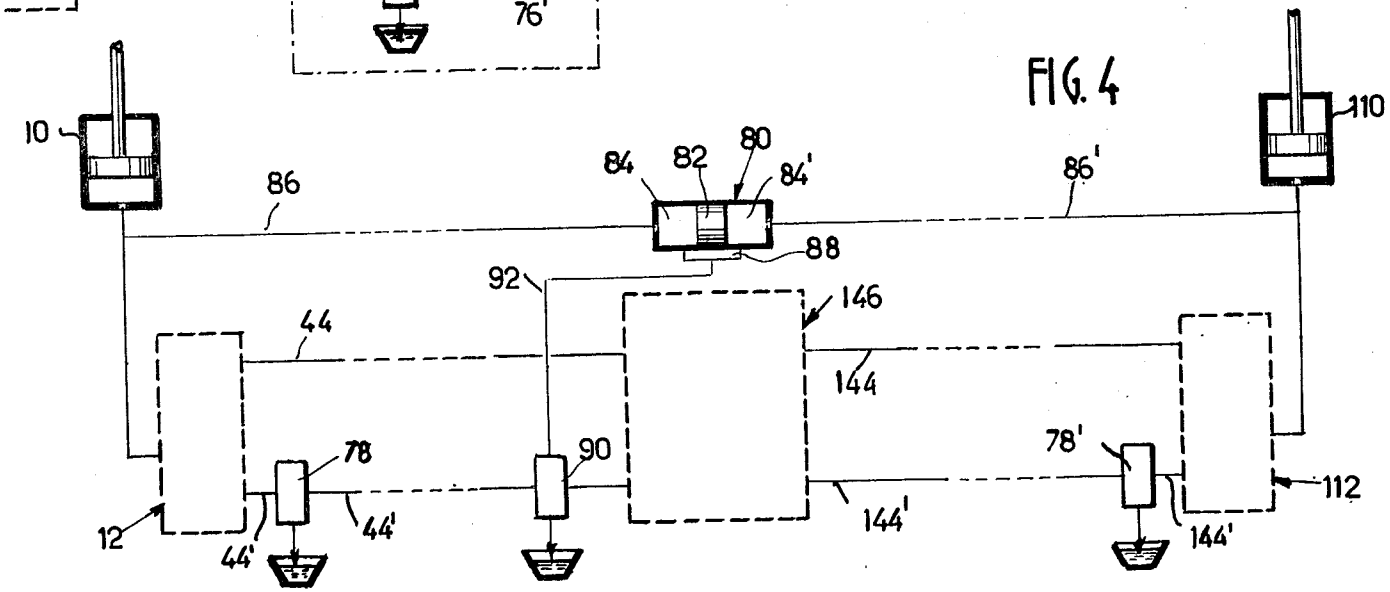
FIG. 4 is a diagram of an installation in accordance with the invention in which provision is made for additional closing and tripping means.

Thus it follows from the foregoing that, in the embodiment of FIG. 4 which relates to the simultaneous control of two circuit-breakers or circuit-breaker modules 10 and 110 as in the embodiment of FIG. 3, an additional trip electrovalve 78 is accordingly mounted on the trip control line 44' either in the proximity of or within the control unit 12. Similarly, an additional trip electrovalve 78' is mounted on the control line 144' within the control unit 112 of the second module. As can readily be understood, the transient excitation of either of these electrovalves has the effect of tripping both modules (or all the modules) since the lines 44' and 144' communicate with each other.

Finally, FIG. 4 shows the application to an installation in accordance with the invention of the safety system for guarding against "discordances" as described in French patent Application No. 77 36277 filed on Dec. 2nd, 1977 in the name of the same inventor.

It will suffice to recall that this system prevents complete performance of an operating order, especially a trip order if simultaneity of operation of all the modules is not maintained. The system essentially comprises a "discordance" detector constituted by a differential pressure detector 80 comprising a cylinder in which a free piston 82 determines two chambers 84–84' which are continuously maintained in communication with the jack chambers 10;14 110 by means of pipe lines 86–86'.

In the event of a pressure difference, the piston 82 undergoes a displacement and actuates a control device 88 which initiates tripping of all the circuit-breakers, thus preventing the potential danger of non-simultaneous closure.

In accordance with the present invention, the device 88 initiates the opening of an additional drain valve 90 which is placed in the trip control line 44' (or 144'). Opening of the valve 90 produces a pressure drop within both the pipes 44' and 144' at the same time and therefore interrupts the tripping operation of all the modules in the event of discordance since a general priority trip order is given. The control connection 92 between the device 88 and the drain valve 90 can be an electrical connection or preferably a mechanical connection as described in the patent cited above.

It should further be noted that, in all the embodiments of the present invention which have been described, there is no hydraulic connection having a large section and a high flow rate between the control units 12–112 and the control cubicle 46 or 146; provision is only made for small-section lines such as the lines 44–44', 144–144', 48–86–86'; these latter can consist of nonrigid hoses which can be uncoiled.

The great advantage of this feature lies in the fact that no shock or dynamic stress is transmitted from the circuit-breakers to the control cubicle. In fact, the circuit-breakers are appliances which operate with abrupt action and control cubicles often contain relatively delicate accessories such as recorders, relays and the like which are often thrown out of adjustment by the shocks transmitted by large-section piping.

Worthy of note among the sensitive accessories to be found in control cubicles are the electrovalves which have a very short stroke in order to produce the extremely short response times required in modern circuit-breakers. In consequence, the hydraulic shocks transmitted to the cubicle by large-section high-flow pipes could result in untimely operations of the circuit-breakers. These various drawbacks are therefore removed by means of the invention.

I claim:

1. A hydraulic control system for a ciruit-breaker or circuit-breaker module which can be remotely actuated from a control cubicle, said system being of the known type comprising a pressure source, a low-pressure container, a device for continuously restoring the circuit-breaker to the open position by elastic action, a hydraulic jack for closing the circuit-breaker in opposition to said elastic means and maintaining the breaker in the closed position when supplied under pressure, a control unit in the immediate proximity of said jack and comprising on the one hand at least one valve for supplying and draining the jack and on the other hand two pilot valves designated as a closure valve and a trip valve and each having a rest position and an active position in which said valves are transiently actuated, said supply and drain valves being switched by said two pilot valves respectively to the supply positions and to the drain position, wherein each pilot valve aforesaid is controlled by a hydraulic device having on the one hand a first input connected to said pressure source and on the other hand a second input connected to a control line for bringing said pilot valve to the active position when the pressure within the control line is lower than the pressure of the source, wherein each control line aforesaid terminates in the control cubicle and is fitted within said control cubicle with a transiently operable drain electrovalve constituting respectively the closure control element and the trip control element of the circuit-breaker and wherein a continuous communication provided with flow-limiting devices is established between said pressure source and each control line aforesaid.

2. A system according to claim 1, wherein the supply drain valve of the jack is provided with a hydraulic circuit for self-maintaining in the supply position and wherein the trip pilot valve is a valve for draining said self-maintaining circuit.

3. A system according to claim 1, wherein each hydraulic device aforesaid operates by differential pressure and comprises a cylinder divided into two chambers by a movable wall, said two chambers being supplied respectively by said first and second inlets and wherein said movable wall actuates the corresponding pilot valve.

4. A system according to claim 1 for controlling a plurality of circuit-breakers or circuit-breaker modules from a single central control cubicle, wherein all the aforesaid control lines which terminate in the hydraulic devices of the valves for tripping all the circuit-breakers are connected together within the central cubicle to a single drain valve constituting a single and transiently operable tripping element for the plurality of circuit-breakers and wherein the same applies to all the aforesaid control lines which terminate in the hydraulic devices of the valves for tripping all the circuit-breakers.

5. A system according to claim 1, wherein the aforesaid control unit for each circuit-breaker or circuit-breaker module comprises only hydraulic elements and wherein said units are connected to the control cubicle only by means of hydraulic connecting lines having a small crosssectional area and a low rate of flow.

6. A system according to claim 1, wherein at least one of the control lines aforesaid and especially the control line which terminates in the hydraulic devices of the trip valves is provided with at least one additional drain valve placed at a predetermined point of said line so that the operation of a single drain valve in said line initiates the operation of the circuit-breaker and especially a tripping operation.

7. A system according to claim 6, wherein at least a number of additional drain valves aforesaid are electrovalves.

8. A system according to claim 6 for an installation for the simultaneous hydraulic control of a plurality of circuit-breakers or circuit-breaker modules in which a safety system is provided for guarding against "discordances" and essentially comprises a discordance detector constituted by a differential pressure detector formed by a cylinder divided by a free piston into chambers which are continuously maintained in communication with the chambers of the breaker-operating jacks, the displacement of said free piston being intended to initiate tripping of all the circuit-breakers, wherein at least one of the additional drain valves is controlled by said differential pressure detector.

9. A system according to claim 1, wherein each control unit aforesaid is provided with a local hydropneumatic accumulator, said accumulator being intended to constitute the source of energy for actuating the breakeroperating jack associated with the control unit considered and being intended to form part of the means for continuously supplying at a low rate of flow both the control lines and the hydraulic devices aforesaid.

10. A system according to claim 1, wherein the means for continuously re-supplying the control lines and the hydraulic devices at a low rate of flow comprise constrictions in the connecting pipes between the accumulator aforesaid and said control lines.

11. A system according to claim 9, wherein said system comprises within the control cubicle a pump for re-charging local accumulators of the control units.

12. A system according to claim 1, wherein the control lines aforesaid consist of non-rigid hoses which can be unrolled and have a small cross-sectional area.

* * * * *